US005393242A

United States Patent [19]

VanDerStuyf

[11] Patent Number: 5,393,242

[45] Date of Patent: Feb. 28, 1995

[54] MODULAR CONNECTOR ASSEMBLY

[75] Inventor: Allen F. VanDerStuyf, Novi, Mich.

[73] Assignee: Electro-Wire Products Inc., Troy, Mich.

[21] Appl. No.: 168,130

[22] Filed: Dec. 17, 1993

[51] Int. Cl.[6] ..... H01R 13/627

[52] U.S. Cl. ..... 439/364; 439/271; 439/701

[58] Field of Search ..... 439/359, 271, 362, 364, 439/595, 596, 598, 686, 695, 701

[56] References Cited

U.S. PATENT DOCUMENTS

| | | | |
|---|---|---|---|
| 4,596,436 | 6/1986 | Kraemer et al. . | |
| 4,944,568 | 7/1990 | Danbach et al. | 350/96.20 |
| 4,950,168 | 8/1990 | Watanabe et al. | 439/34 |
| 5,100,336 | 3/1992 | Burgess et al. | 439/277 |
| 5,122,077 | 6/1992 | Maejima et al. | 439/398 |
| 5,125,854 | 6/1992 | Bassler et al. | 439/607 |
| 5,190,482 | 3/1993 | VanDerStuyf et al. | 439/686 |

*Primary Examiner*—Khiem Nguyen

*Attorney, Agent, or Firm*—Gifford, Krass, Groh, Sprinkle, Patmore, Anderson & Citkowski

[57] ABSTRACT

A modular connector assembly particularly useful in the wiring systems of motor vehicles. The connector assembly includes a single terminal connector member and a plurality of separate terminal connector members which collectively and matingly engage with the single connector member. The separate terminal members are contained in the chambers of a multi-chambered flange which retains them in mating orientation with respect to the single connector member. An H-bar is configured to engage and unite the plurality of separate connector members and the flange to form a united assembly. The united assembly is then engaged with the single connector member to establish electrical communication therebetween.

11 Claims, 3 Drawing Sheets

MODULAR CONNECTOR ASSEMBLY

FIELD OF THE INVENTION

This invention relates generally to electrical connectors and, more particularly, to multi-terminal electrical connectors. More specifically, the invention relates to a connector assembly wherein a plurality of separate terminal connector members are assembled for connection with a single, mating terminal connector member.

BACKGROUND OF THE INVENTION

The electrical systems of motor vehicles of all types are becoming increasingly complex. Generally, motor vehicles are provided with a wiring harness which is a prefabricated bundle of wires having appropriate terminals for interconnection of the appropriate electrical components and systems of the vehicle. Often, a wiring harness, or a portion thereof, must pass through a vehicle bulkhead, including firewalls, acoustical barriers-panels, pressure resistant walls and the like. Generally, it has been found most advantageous to utilize multiple terminal connectors to convey a number of electrical terminal connectors through such bulkheads. Additionally, multiple terminal connectors are employed in other situations, both vehicular and non-vehicular, where very large numbers of electrical terminals must be reversibly interconnected.

It is necessary that any multiple terminal electrical connector provide for the rapid, accurate, reversible and reliable interconnection of the appropriate wire pairs. Generally, most multiple terminal connectors comprise a pair of mutable base members, each having one or more of the appropriate terminals retained therein. The base members maintain the terminals in the appropriate orientation and allow for ready connection and disconnection thereof. In most vehicular applications, it is further desirable that the connectors provide for environmentally sealed interconnection of the terminals so as to prevent failures due to moisture or corrosion. It is additionally desirable that the connectors be immune to loosening from vibration or other mechanical impact.

U.S. Pat. No. 5,100,336, the disclosure of which is incorporated herein by reference, teaches a multiple terminal connector assembly comprising a male and female connector, each connector including a plurality of sockets for receiving electrical terminal members and each further including a wedge member for locking the terminals into the sockets. The connector assembly described in the '336 patent further includes a particularly configured sealing gasket associated with one of the connectors and a flange associated with the other of the connectors, the gasket and flange being operable to create a vertical seal which limits passage of moisture therepast. The connector assembly further includes a locking bolt for affixing the two connectors in mated engagement and an elastomeric seal extending along at least a portion of the length of the bolt.

In the '336 patent, the connector pair of the assembly each includes the same number of terminals. However, in particular applications, for example the heavy truck market, there is often the need to couple a number of smaller, multi-terminal electrical connectors into a single, larger mating connector. For example, a heavy truck may include a number of separate wiring harnesses for the vehicular operating system, the sleeper cab, the trailer lights, and the like. The specific type of harnesses used on a particular truck model will depend upon the basic configuration of the truck, as well as the particular options elected for that particular model; thus, actual harness configurations vary greatly from vehicle to vehicle.

It is generally desirable to minimize the inventory of parts needed by a manufacturer. In furtherance of that goal, it is most efficient to keep the engine side terminal connector constant, and to plug a number of separate, multi-terminal harnesses into that basic connector. It is further desirable that all the connections be stable under conditions of vibration, salt spray, and the like, and that they be capable of being rapidly and reliably coupled and uncoupled.

Thus, it would be highly desirable to have a multi-terminal connector assembly wherein a plurality of separate, multi-terminal harness connectors may be plugged into a single, basic engine side connector. It would be especially desirable if such a connector assembly were environmentally sealed from the ambient, operating environment of the vehicle.

SUMMARY OF THE INVENTION

The present invention provides a modular connector system wherein a number of separate, multi-terminal plugs may be assembled together into a unitary assembly which will then mate with the standard connector, such as the female portion of the 76-way connector disclosed and claimed in U.S. Pat. No. 5,100,336. The modular connector assembly includes a plurality of separate, multi-terminal connector members (such as plugs), a multi-chambered flange to receive the plurality of separate connector members and orient them for connection with a single, mating connector member, and an H-bar which clamps the plurality of separate connector members and the flange into a united assembly. Means are provided for connecting the united assembly to the mating, single connector member such as a locking bolt similar to that described in the '336 patent. To this end, both the single connector member (generally a receptacle connector member) and the housing of the multi-chambered flange may have a bore formed therein through which the locking bolt is threaded to join the united assembly of separate connector members and flange with the single, mating connector member in electrical communication.

Each of the plurality of separate connector members may be generally similar to those described in the '336 patent and include a body portion, a sealing gasket, a locking wedge, and a back cover. Each of the separate connector members can retain a number of pin or socket terminals therein by means of the locking wedge. The flange and the separate connector members may include sealing gaskets which are configured to provide a tight environmental seal. Keying features may also be incorporated to provide for proper alignment and orientation and location of the assembly.

As mentioned, the modular connector assembly further includes an H-bar which unites the separate connector members and the flange. The H-bar has an aperture formed therein for passage of the locking bolt to engage the bolt hole in the larger, mating connector. By tightening the bolt, the entire assembly is retained in a positive locked engagement. The H-bar is preferably configured so that any over-torque on the bolt will produce a bowing or breakage in the cross bar of the H-assembly. This feature prevents internal damage to the connector caused by over torquing which would not be immediately visible. In further embodiments, a dummy plug may be included to close off portions of the larger connector if the entirety thereof is not used.

The modular connector assembly of the present invention provides for great flexibility in manufacture. In some instances, the manufacture of the hardware can be split between different manufacturers; for example, the separate harnesses may be manufactured at different sites and each coupled to its own separate connector member. One of these assemblies may be inserted into the multi-chambered flange by one manufacturer, and the other assembly may be provided in connection with the H-bar. The entire assembly may then be put together on site to provide the completed connector assembly. Furthermore, the modular connector assembly of the present invention may be employed with plugs which contain pin terminals, socket terminals, or a combination of both.

BRIEF DESCRIPTION OF THE DRAWINGS

The following detailed description is best understood by reference to the following drawings in which.

DETAILED DESCRIPTION OF THE PREFERRED EMBODIMENTS

Figure 1:
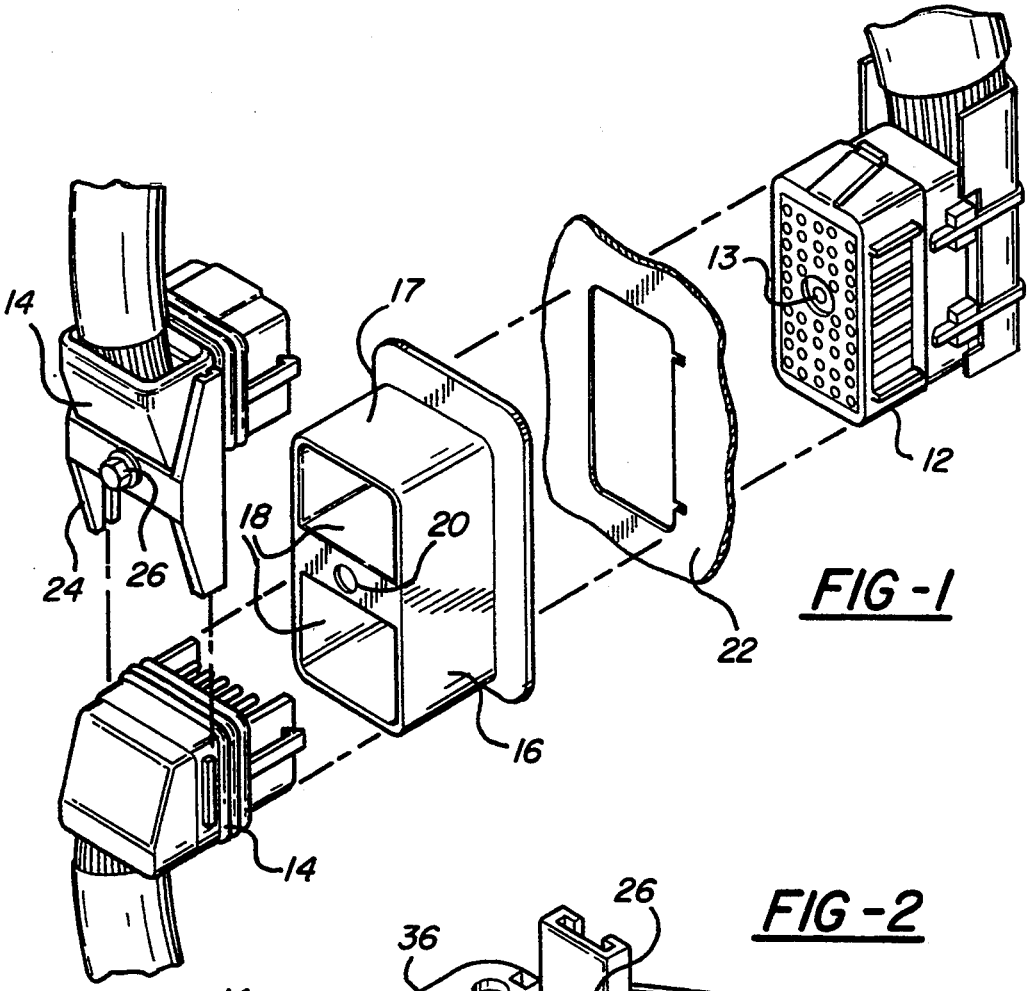
FIG. 1 is an exploded, perspective view of a modular connector assembly constructed according to the present invention.

Throughout the following detailed description, like numerals are used to reference the same elements of the herein invention shown in like figures thereof. Referring now to the drawings, and in particular to FIG. 1, there is shown a modular connector assembly 10 according to the present invention including a single, terminal connector member 12 having a bolt hole 13 formed therethrough. Typically, the single connector member 12 may be a receptacle connector member, as is depicted, or, alternatively, could be a plug connector member. An example of such a connector member is disclosed in U.S. Pat. No. 5,100,336 discussed earlier.

Figure 4:
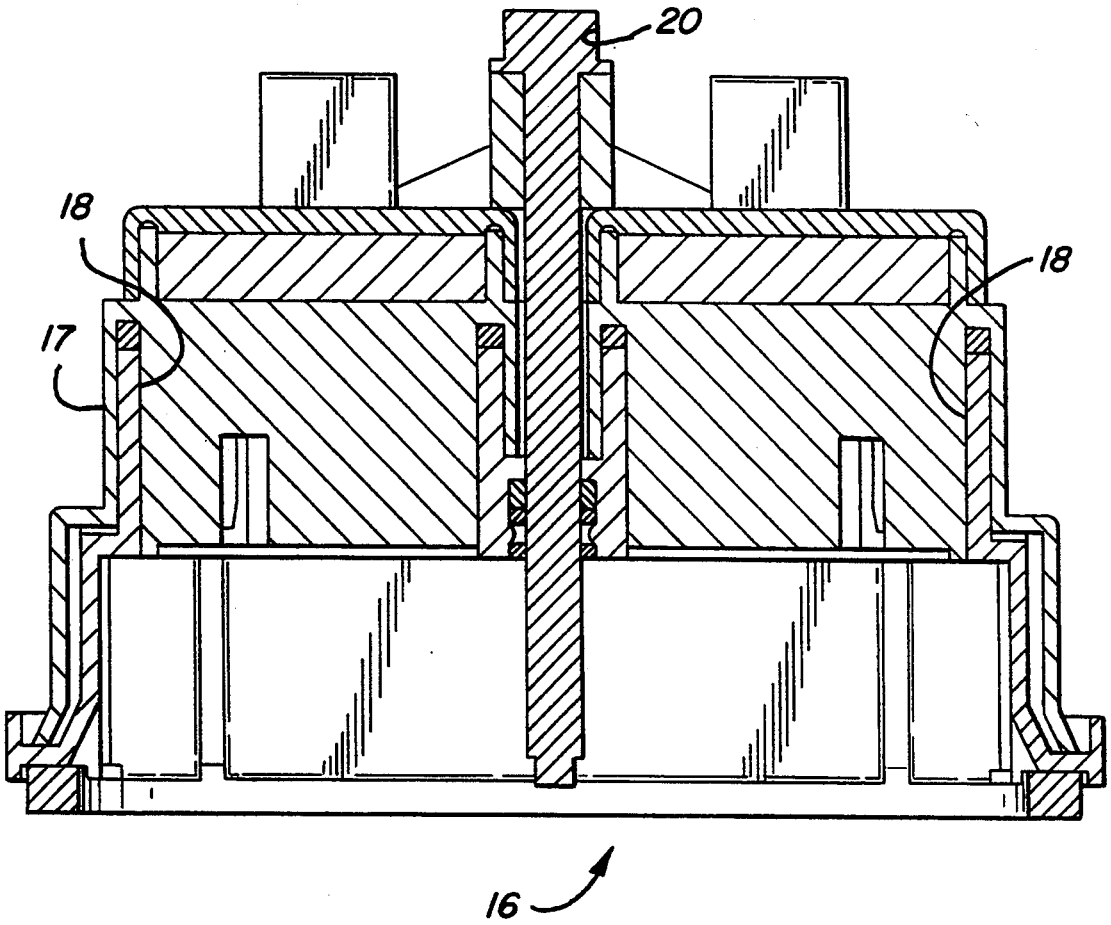
FIG. 4 is a cross section of the multi-chambered flange of FIG. 3 showing the internal structure thereof.

The modular connector assembly 10 further comprises a plurality of separate terminal connector members 14 for collective and mating engagement with the single connector member 12. As depicted, each separate connector member 14 is a plug connector member, but could equally well be a receptacle connector member. The plurality (in this case two) of connector members 14 are received in a multi-chambered flange 16, a detailed cross-sectional view of which is depicted in FIG. 4. The flange 16 includes a housing 17, a plurality (in this case two) of chambers 18 formed therein to receive the plurality of separate connector members 14, and a bore 20 extending through the housing 17.

Figure 3:
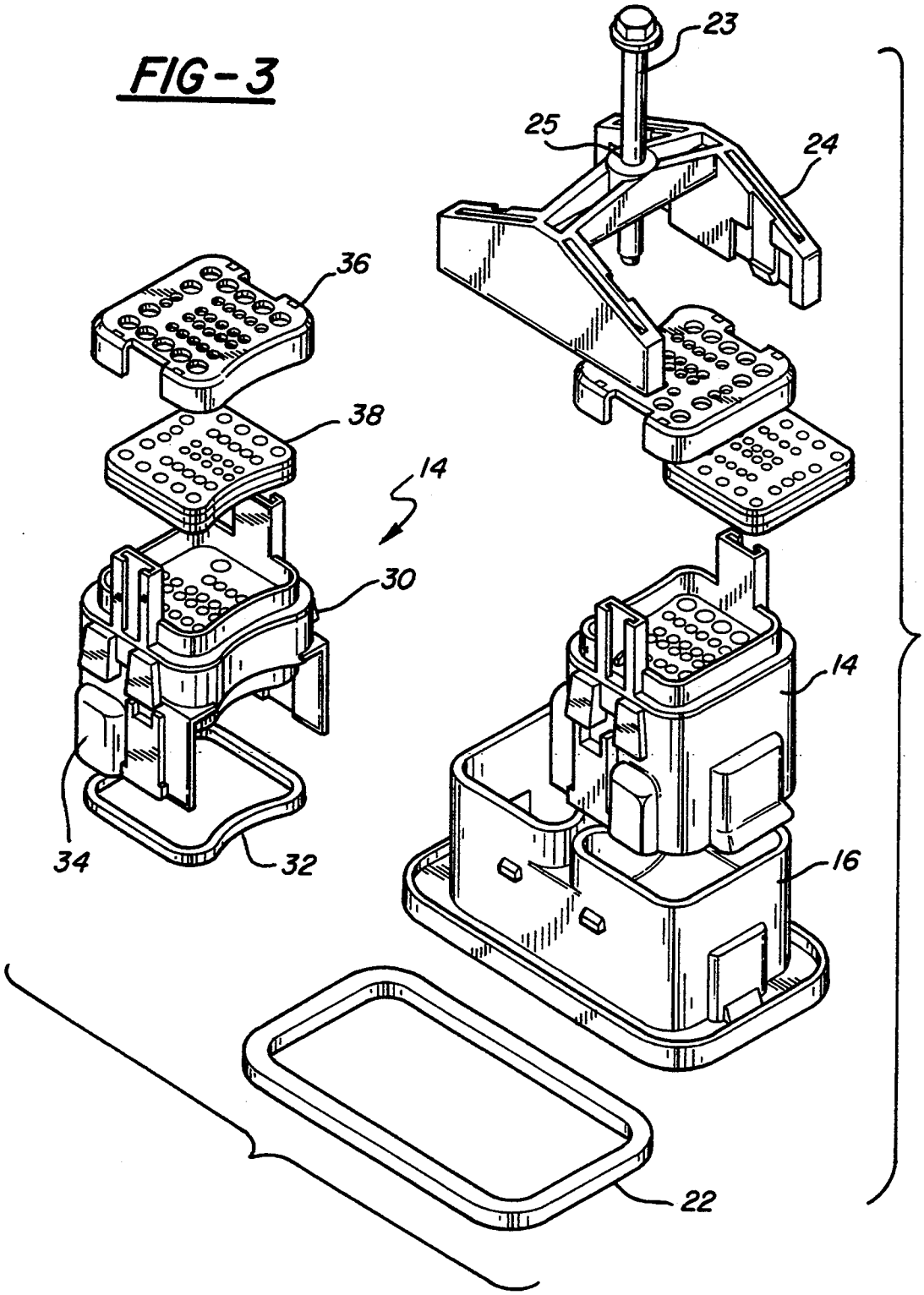
FIG. 3 is an exploded, perspective view of the united assembly of FIG. 2.

FIG. 3 depicts an exploded view of each of the separate connector members 14 employed in the depicted embodiment of the assembly 10 of the present invention. The depicted separate connector members 14 each include a body 30, a sealing gasket 32, a locking wedge 34, a back cover 36, and an internal back gasket 38. Details of the construction and operation of the depicted connector member 14 may be gleaned from the disclosure of U.S. Pat. No. 5,100,336. As described therein, the locking wedge functions to orient and lock a number of individual electrical terminals (either plugs or sockets) ill the body 30 of the connector member 14. The locking wedge 34 may be moved from a prelocked position for assembly and shipping purposes, to a permanent locked position. Of course, the present invention is not limited to use with connector members such as those depicted, but may be used with other types of connector members.

Figure 2:
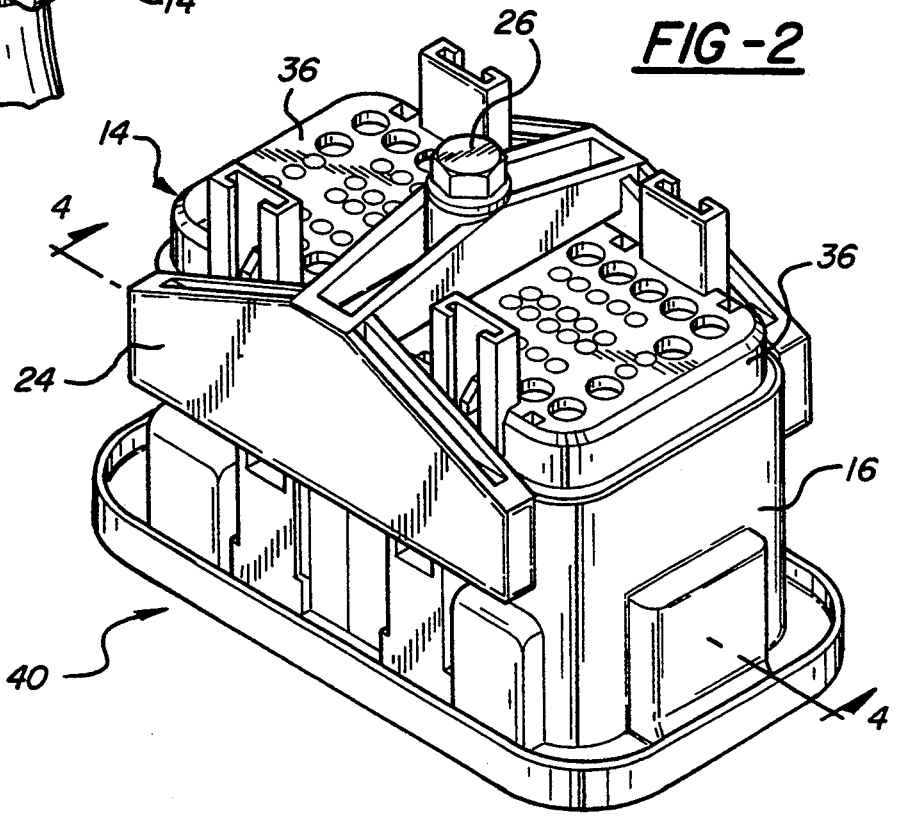
FIG. 2 is a perspective view of the united assembly of flange, separate connector members, and H-bar.

The assembly 10 of the present invention further includes an H-bar 24 which, like the single connector member 12 and the housing 17 of the flange 16, has an aperture 25 formed therein for passage therethrough of a locking bolt 26 which will hold the assembly together. As can best be seen in FIGS. 2 and 3, the H-bar 24 engages the flange 16 and separate terminal members 14 to clamp them together into a united assembly 40 of flange 16, separate connector members 14, and H-bar 24, such as is depicted in FIG. 2. The united assembly 40 may then be engaged with the mating single connector 12 and locked in electrical communication therewith by means of lock bolt 26.

Optionally, a sealing gasket 22 may be provided which seals the juncture between the united assembly 40 and the single connector member 12 to maintain the integrity of the electrical connection therebetween and prevent ingress of moisture, dirt, corrosive substances, etc. In order to aid in assembly of the subcomponents and the final connection of the united assembly and single connector member, various keying features may be provided, such as are known in the prior art.

Preferably, the flange and the major portion of the connector members are molded from polymeric material. Of course., as explained in U.S. Pat. No. 5,100,336, the individual terminals which are inserted into the connector members are formed of an electrically conductive material, such as a conductive metal. Similarly, the H-bar is molded of a polymeric material which has sufficient strength to hold the united assembly together. However, because of the configuration of the H-bar, over-torquing of the bolt when the connector members are united will cause the crosspiece of the H-bar to break, rather than damaging the internal components of the connector members. This is an important feature since breakage of the H-bar is immediately obvious, whereas damage to internal components is not; this feature helps ensure the quality of the overall assembly. Also, the H-bar can be readily replaced.

Of course, while the depicted embodiment shows a modular connector assembly including a single terminal member of the type disclosed in U.S. Pat. No. 5,100,336, the invention is not limited to the depicted embodiment. By suitably configuring the flange and the separate connector members, the united assembly of H-bar, flange and connector members may be used with another type of design of the single connector member without departing from the claims of the present invention. Thus, the present invention may find applicability in any complex electrical systems wherein a plurality of wire harnesses of different configurations are inserted .into a standard single connector member.

Figure 5:
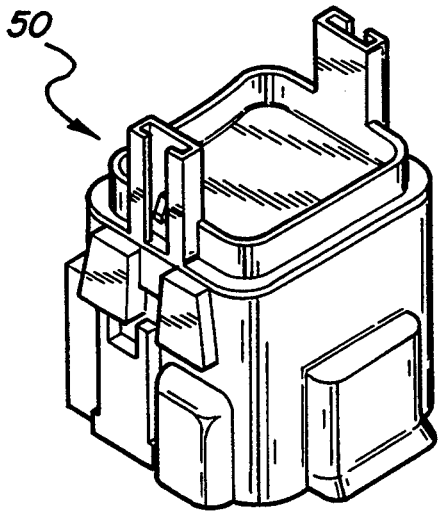
FIG. 5 is a perspective view of a blank connector member according to the present invention.

In a further refinement of the present invention, a blank unit 50, shown in FIG. 5, may be fabricated for insertion into one of the chambers 17 of flange 16. The blank unit 50 will be used in cases Where the number of separate connector members 14 needed for the wiring system is less then the number needed to mate with all of the terminals of the single, mating connector member. The blank unit 50 will serve to prevent accidental short circuiting of terminals of the single connector member 12 which would otherwise be exposed when a united assembly containing less than a full complement of separate connector members is inserted into the single connector member and to maintain sealing.

A modular connector assembly useful in complex wiring systems wherein it is often necessary to insert a variety of connectors attached to wiring harnesses with a single, standard connector member has been described with reference to certain exemplifications and embodiments thereof. For example, means other than the depicted bolt may be used to connect the united assembly of flange, H-bar and separate terminal members to the single, mating terminal member. Doubtless, by applying the teachings of the present disclosure, other design variations of the assembly of the present invention may be obvious to one skilled in the art without departing from the scope of the present invention. It is the claims appended hereto and all reasonable equivalents thereof which define the true scope of the present invention rather than the specific embodiments and exemplifications depicted herein.

I claim:

1. A modular connector assembly including:

a single terminal connector member:

a plurality of separate terminal connector members for collective end meeting engagement with said single connector member;

a flange including a housing and a plurality of chambers formed in said housing to receive said plurality of separate connector members therein and retain them in mating orientation with respect to said single connector member;

an H-bar figure to engage and unite said plurality of separate connector members and said flange to form a united assembly; and means for retaining the united assembly in electrical communication with the single connector member.

2. The assembly of claim 1 wherein the single connector member is a receptacle connector and each of the plurality of separate terminal connector members is a multi-terminal plug connector member.

3. The assembly of claim 1 further comprising a sealing gasket for sealing the electrical connection between the united assembly and the single connector member from the ambient environment.

4. The assembly of claim 1 wherein each of said plurality of separate terminal connector members further comprises a body portion, a sealing gasket, a locking wedge and a back cover.

5. The assembly of claim 4 wherein each of said plurality of separate terminal connector members is a plug terminal connector member including a plurality of individual terminals retained therein by said locking wedge.

6. The assembly of claim 1 wherein the separate connector member, the flange housing and the T-bar each include means forming a borehole therethrough, and the means for retaining comprises a locking bolt insertable through each borehole.

7. A modular connector assembly for insertion into a single terminal connector member having a bolt hole formed therein, said assembly comprising:

a plurality of separate terminal connector members for collective end meeting engagement with said single connector member;

a flange including a housing and a plurality of chambers formed in said housing to receive said plurality of separate connector members therein and retain them in mating orientation with respect to said single connector member, said housing including means forming a bore extending therethrough;

an H-bar figure to engage and unite said plurality of separate connector members and said flange; and a locking bolt extendable through the bore of said flange housing for engagement with said bolt hole to retain the assembly in electrical communication with the single connector member.

8. The assembly of claim 7 wherein the single connector member is a receptacle connector and each of the plurality of separate terminal connector members is a multi-terminal plug connector member.

9. The assembly of claim 7 further comprising a sealing gasket for sealing the electrical connection between the united assembly and the single connector member from the ambient environment.

10. The assembly of claim 7 wherein each of said plurality of separate terminal connector members further comprises a body portion, a sealing gasket, a locking wedge and a back cover.

11. The assembly of claim 10 wherein each of said plurality of separate terminal connector members is a plug terminal connector member including a plurality of individual terminals retained therein by said locking wedge.

* * * * *

UNITED STATES PATENT AND TRADEMARK OFFICE

CERTIFICATE OF CORRECTION

PATENT NO. : 5,393,242
DATED : February 28, 1995
INVENTOR(S) : VanDerStuyf

It is certified that error appears in the above-indentified patent and that said Letters Patent is hereby corrected as shown below:

Column 4, line 7: Replace "ill" with --in--.

Column 4, line 38: Replace "course.," with --course,--.

Column 4, line 65: Replace ".into" with --into--.

Column 6, line 13: Replace "T-bar" with --H-bar--.

Signed and Sealed this

Third Day of October, 1995

*Attest:*

Bruce Lehman

BRUCE LEHMAN

*Attesting Officer*

*Commissioner of Patents and Trademarks*